United States Patent [19]

Prince

[11] Patent Number: 4,499,133

[45] Date of Patent: Feb. 12, 1985

[54] MULTI-PURPOSE SHEET

[76] Inventor: Connie J. Prince, 250 Ohua #9C, Honolulu, Hi. 96815

[21] Appl. No.: 492,680

[22] Filed: May 9, 1983

[51] Int. Cl.[3] ..... A45F 4/00; B32B 3/02

[52] U.S. Cl. ..... 428/81; 2/89; 5/417; 52/4; 135/95; 428/192

[58] Field of Search ..... 428/192, 81, 83; 2/69, 2/89; 5/417; 52/3, 4, 5, 23; 135/87, 95; D21/253, 254, 255

[56] References Cited

U.S. PATENT DOCUMENTS

| | | | |
|---|---|---|---|
| D. 29,651 | 11/1898 | Shoenberg | D21/253 X |
| 3,013,274 | 12/1961 | Dike | D6/265 X |
| 3,226,737 | 1/1966 | Rote | 5/417 |
| 3,862,876 | 1/1975 | Graves | 428/83 |
| 4,125,903 | 11/1978 | Farrell | 5/343 X |
| 4,223,056 | 9/1980 | Di Fronzo | 428/188 X |
| 4,272,575 | 6/1981 | Egigian | 428/192 X |
| 4,405,673 | 9/1983 | Fridley et al. | 428/131 X |

*Primary Examiner*—Henry F. Epstein
*Attorney, Agent, or Firm*—James C. Wray

[57] ABSTRACT

A lightweight, single-ply blanket has inwardly opening, triangular pockets sewn beneath each of its four corners. The corners of the blanket are also provided with extending, braided cord loops to add anchoring versatility and to provide rapid emptying of the entire contents of the pockets by lifting the loops.

9 Claims, 17 Drawing Figures

FIG. 13
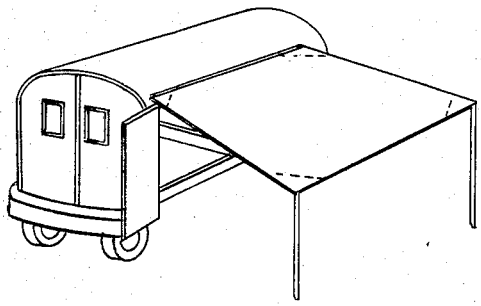
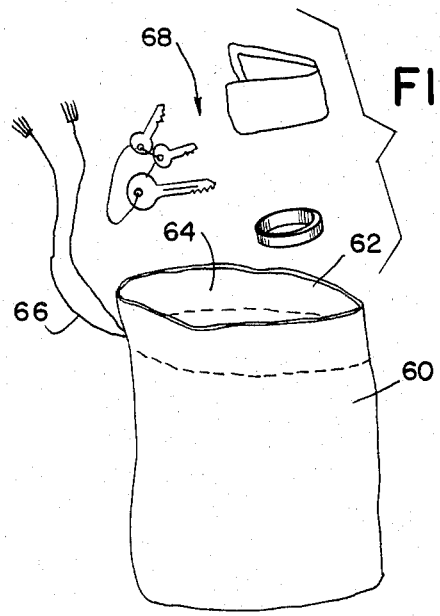
FIG. 7
FIG. 8
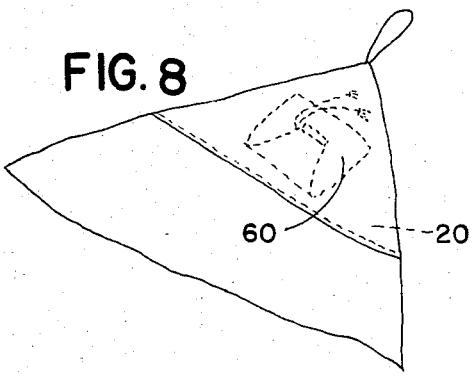
FIG. 9
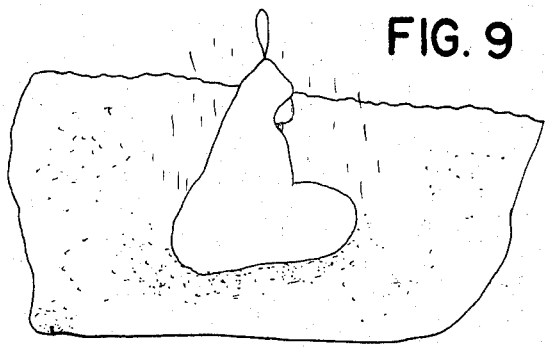
FIG. 10
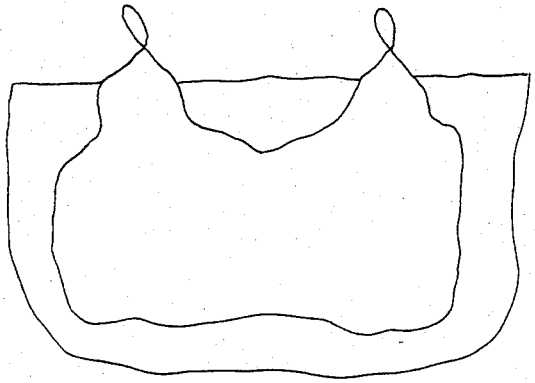
FIG. 11
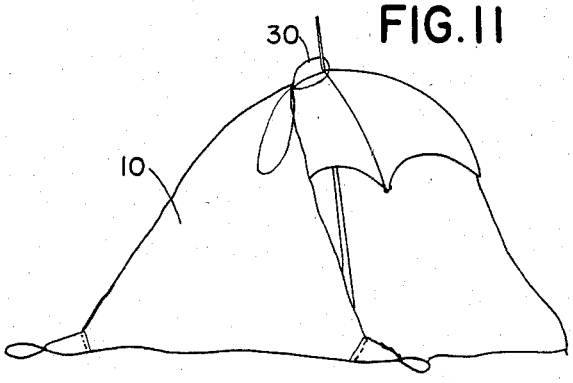
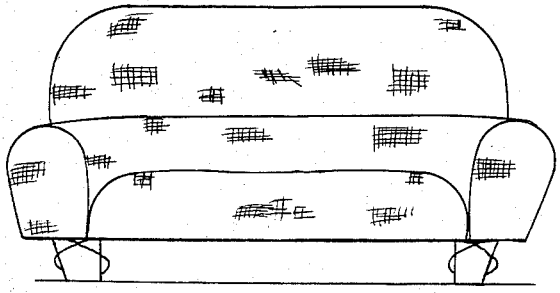
FIG. 14
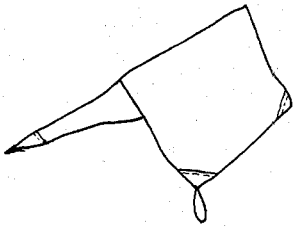
FIG. 12

MULTI-PURPOSE SHEET

BACKGROUND OF THE INVENTION

This invention relates to multi-purpose sheets, especially beach blankets, and particularly pocketed beach blankets.

Beach blankets or towels with pockets for holding articles are known.

A problem exists with pocketed beach blankets in that, when the pockets are used to receive weighted materials for holding the blanket down, either the pockets are not correctly distributed across the blanket to hold the blanket in the desired position or the pockets aid in the fouling of the upper surface of the blanket with unwanted sand or weighting materials.

One of the common problems associated with the use of beach blankets is that the blankets must be shaken to remove the sand which covers them before using the blankets or before gathering the blanket to remove it when leaving the beach. Shaking the sand may cause discomfort to the user of the blanket and may embarrass the user on crowded beaches where the sand irritates or endangers bystanders.

The present invention is designed to overcome the problems of the prior art.

BRIEF DESCRIPTION OF THE INVENTION

The present invention is a multi-purpose sheet or beach blanket. The blanket has triangular, inward and downward opening corner pockets to receive sand or weighting materials or to hold heavy articles, such as soft drink cans.

Loops extend outward from corners of the blanket so that the loops may be raised to empty the pockets. As the corner of the blanket is lifted by the loop, complete emptying of the pocket on the beach and not on the blanket is assured. The blanket may be lifted from the sand, for example, by lifting each of the four loops and then either folding the blanket or bunching the blanket into its drawstring carrying pouch.

The drawstring carrying pouch is preferably made of the same material as the blanket. When the blanket is deployed for use, valuables are placed within the drawstring carrying pouch and are placed within a corner pocket beneath the blanket for concealing the valuables and, at the same time, weighting the blanket.

Preferably, the blanket and carrying pouch are made of the same, identical, bright color for attractiveness and to provide concealment of the carrying pouch so that it does not appear of a color different from the blanket. The brightly colored carrying pouch falls out of the blanket when the corner is lifted to serve as a reminder of the location of the valuables when leaving the beach.

The unique design and location of the pockets provides a unique, self-cleaning function of the blanket. When the blanket is placed on the sand and after the pockets are filled, any breeze tends to billow the blanket causing an upward curvature which compels sand to roll off the blanket. Continuous billowing of the blanket in a light breeze is noted when the blanket is unoccupied. The natural billowing and upward rounding of the blanket in a breeze provide an indication of the position of the blanket when one leaves, such as for swimming. In addition, the upward billowing provides a highly desirable raised surface, such as for carrying notices and advertising.

The unique billowing function is provided by the self-centering function of the weighted corner pockets. After the pockets are weighted with loose materials, a slight raising of the medial portion of an edge, such as by lifting in a small breeze, slightly lifts an edge of the pocket and sends weighting material toward the center of the pocket to further promote the gentle billowing and rounding of the blanket when not in use. The same action causes the blanket to shed water droplets and to dry when the blanket is not in use.

Uniquely, with the present invention, one need not have the usual concern of brushing sand off the body before lying on the blanket because, as soon as one leaves the blanket, the billowing automatically removes the sand.

The loops, which are primarily intended to be used in emptying the pockets, also provide auxiliary anchoring means for the blankets. In one form of use of the invention, two pockets may be weighted, and two of the loops may be passed over the point of a beach umbrella to provide auxiliary shade or wind shelter. One or two of the loops may be raised to empty loose materials from one or two of the pockets, which then may be worn as hats to provide a rain or wind shelter for one or two persons.

The unique loops provide convenient carrying for articles deposited in the middle of the blanket, such as when carrying bulky items from the beach. The blanket may be laid in a depression and filled with water to form a convenient pool.

The loops at the corners of the blanket uniquely provide anchoring for raising corners of the blanket to provide a shelter or a tent.

Preferably, the blanket is an extremely lightweight blanket made with inward and downward opening pockets sewn in its corners. It is made in two sizes, 82 inches by 60 inches or 70 inches by 40 inches, with a drawstring bag approximately 10 inches by 6 or 7 inches.

A primary object of the invention is to provide a blanket that does not blow away on a beach and a blanket that one does not have to shake in a neighbor'face. Filling the downward and inward opening pockets with sand when one arrives at the beach holds the blanket stationary. There is no need to shake the blanket because it billows in the wind when unoccupied, rolling sand off the side of the blanket.

In a preferred embodiment, the blanket is made from any lightweight fabric. When it is created in waterproof fabric, it becomes a raincoat with a pocket worn on the head as a hat, or it can be worn as a windbreaker. It can be used as a tent. When no loose materials are available, corner loops may be used with stakes.

The unique billowing and self-cleaning action also provides the rolling off of water and causes the blanket and the shaded sand beneath it to remain cool even in hot sun.

In a preferred form of the invention, the pockets have sides of at least about 12 inches stitched along corner edge portions of the sheet. The substantial pockets ensure the firm anchoring of the blanket when filled with loose materials and provide the unique self-cleaning, drying and cooling billowing function and, at the same time, provide a size desirable for use as a hat, when using the blanket as a shelter or windbreaker or rain gear. The lightweight, pocketed beach blanket is ideal for use in hiking and may be carried as standard equipment, such as in glove compartments of automobiles for emergency use. The bright color is useful in attracting attention to a lost hiker or one requiring emergency aid.

Because of the unique size and loops, the blanket is suitable to be worn as clothing for women by wrapping one end of the blanket above the chest and tying in back and bringing the other end of the blanket downward in front of the wearer, through the legs, up and around the back and tying the loops in the front, which provides a stylish looking garment.

These and other objects and features of the invention are apparent in the disclosure, which includes the specification with the above and ongoing description and claims and the drawings.

BRIEF DESCRIPTION OF THE DRAWINGS

FIG. 5*a* is a cross-sectional, schematic detail of the structure at the corner shown in FIG. 5.

FIG. 7 is a detail of the drawstring bag which alternately houses the blanket and valuables.

FIG. 8 is a detail showing the concealing of the pouch in a corner pcoket.

FIG. 9 shows the blanket being used by one person as rain gear.

FIG. 10 shows the blanket being worn by two persons as a rain or wind shelter.

FIG. 11 shows two loops of the blanket around the point of a beach umbrella in use as a sun and wind shelter.

FIG. 12 shows the blanket used as a tent.

FIG. 13 shows the blanket used as a tarp, and FIG. 14 shows the blanket used as a furniture cover.

DETAILED DESCRIPTION OF THE DRAWINGS

Figure 1:
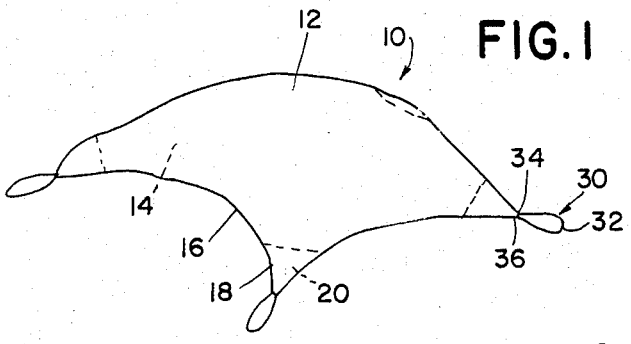
FIG. 1 is a view of a preferred embodiment of the beach blanket showing the billowing.

Referring to FIG. 1, a multi-use sheet represented by beach blanket 10 has an upper surface 12 and a lower surface 14. Peripheral edges 16 of the blanket have corner portions 18 to which edges of pockets 20 are attached.

Figure 2:
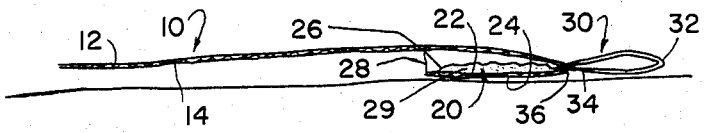
FIG. 2 is a detail of a corner of the beach blanket showing the inward opening pocket filled with sand.

As shown in the cross-sectional detail of the corner in FIG. 2, pocket 20 is made of a triangular piece 22, which may be sewn or bonded or otherwise fixed to the corner edge portions 18 of the blanket. The piece 22 which forms pocket 20 has a lower surface 24 and an upper surface 26, which faces the lower surface 14 of the blanket 10. The inner edge 28 of the pocket is not attached to the blanket, thereby forming an opening to receive sand or loose weighting materials 29. As the blanket billows, as shown in FIG. 1, the sand tends to be centered in each pocket 20, which permits air to flow under the edges 16 of the blanket to provide the billowing and self-cleaning function.

As shown in FIGS. 1 and 2, each corner of the blanket is provided with a cord means 30 having a remote loop 32 and a proximal anchor portion 34 which is permanently connected to the corner 36 of the blanket-forming sheet and the pocket-forming piece.

Uniquely, in the present invention, the more a blanket billows, the more sand tends to move deeply into the corner. Uniquely, no sand from the pocket may spill on the blanket no matter how much the blanket billows and flaps in its self-cleaning action.

Figure 3:
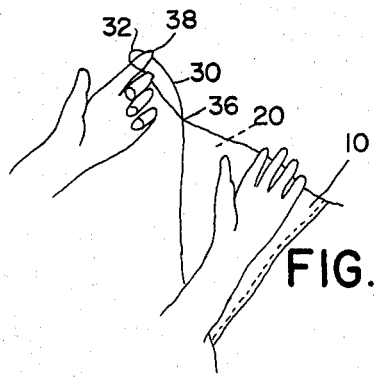
FIG. 3 is a detail showing the removal of sand from a pocket of the beach blanket by lifting the loop.

As shown in FIG. 3, when one is ready to leave the beach, an index finger 38 of one hand is inserted through the loop 32 of cord 30, and the corner 36 is raised, emptying the pocket 20.

To ensure that the pocket is emptied directly on the surface of the sand so that sand grains cannot be blown against neighbors, the opposite hand, as shown in the drawing, is placed on the blanket 10 near the corner when lifting the cord means 30.

The cord means 30 may be constructed of any suitable strand-forming material, such as tape or reverse-sewn tape. Preferably, the cord means is made of a flexible cord base with a braided, knitted or woven covering of a well known, commercially available type.

Figure 4:
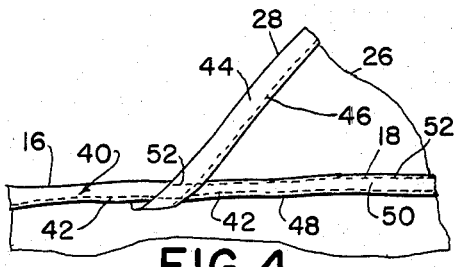
FIG. 4 is a detail of a seam joining the sheet and a corner piece.
Figure 4A:
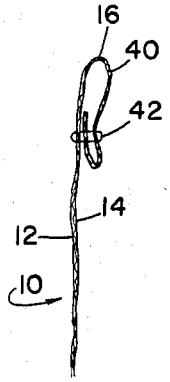
FIG. 4*a* is a detail of the seam of the sheet shown in FIG. 4.
Figure 4B:
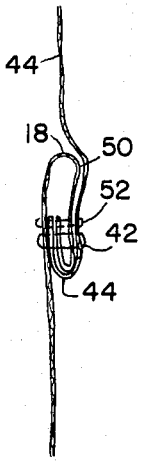
FIG. 4*b* is a detail of the preferred seam where an open corner of the pocket connects with an edge of the sheet.

As shown in FIGS. 4, 4*a* and 4*b*, the edge 16 of sheet 10 is re-entrantly folded inward to form a seam 40 which is secured by stitches 42. A similar seam 44 is formed by folding the edge 28 of the pocket piece inward on upper surface 26 and securing the seam with stitches 46.

Figure 4C:
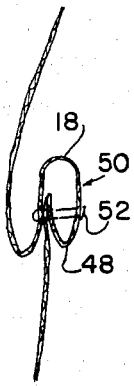
FIG. 4*c* shows a pocket seam detail.

The side edge 48 of the pocket piece is folded inward around the edge portion 18 of the blanket to form the seam 50 which is secured by stitches 52, as shown in FIG. 4*c*.

As shown in FIG. 4*b*, the seam 44 along the open edge 28 of the pocket is folded into the seam 50 where it is secured by stitches 52, and the stitches 42 are continued across the seam 44 to result in a double-stitched inner section to ensure that the pocket does not tear from the blanket.

Figure 5:
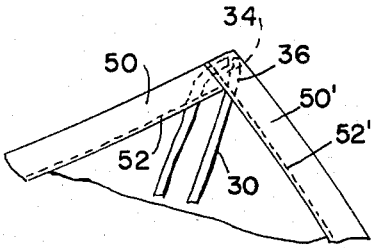
FIG. 5 is a detail of the seam at an inner corner of the pocket.

As shown in the inside view in FIG. 5, the seam 50′ along one edge of the pocket piece-blanket inner section overlies the similar seam 50 and is secured over that seam and along the edge by stitches 52′.

The anchor end 34 of the lifting cord 30, which is outside of the corner, as shown in FIG. 5, is secured in the seams 50 and 50′. As shown in cross-sectional view, the anchor end 34 of the cord 30 is secured by several stitches in the intersecting seams.

Figure 6:
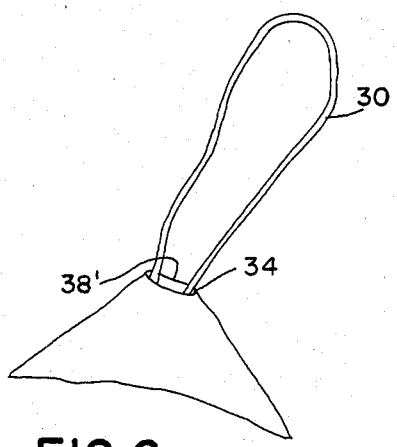
FIG. 6 is a detail of the opposite side corner.

As shown in FIG. 6, the anchor end 34 of the cord 30 emerges through an inwardly folded opening 38′ in the corner.

In the preferred embodiment, the entire beach blanket is stored within a drawstring pouch 60, which is constructed of a material identical to the material of the blanket and pocket pieces. Open end 62 has a seam 64 which receives a drawstring 66. When the blanket is removed from pouch 60, valuables generally indicated by the numeral 68 may be placed within it.

As shown in FIG. 8, the pouch 60 with the valuables 68 is placed in a corner pocket 20. Sand may be added in the corner pocket to further conceal the presence of the pouch with the valuables.

As shown in FIGS. 9 and 10, the blanket is suitable for use as a rain cape or as a shelter from wind and rain for one or two persons who wear the large corners as hats.

As shown in FIG. 11, when two of the cords 30 are looped over the point of a sun umbrella, and two of the corners are weighted, the blanket forms a convenient sun shade and wind screen for beachgoers.

By using center poles or a cord stretched between two trees, the blanket conveniently makes a tent, as shown in FIG. 12. The blanket may be used as a roof extension for camping vehicles or tents by fixing two of the loops to the main structure and supporting the two distal loops with poles, as shown in FIG. 13.

While the invention has been described with reference to specific embodiments, modifications and variations of the invention may be constructed without departing from the scope of the invention.

The scope of the invention is defined in the following claims:

I claim:

1. A lightweight multi-purpose sheet comprising a large, flat body having upper and lower sides and having peripheral edges, the peripheral edges forming at least one corner, a triangular piece mounted in the corner, the triangular piece having upper and lower surfaces and having first and second and third edges, the upper surface of the corner piece being juxtaposed to a lower surface portion of the multi-purpose sheet and first and second edges of the corner piece being connected to portions of the edges of the sheet which form the corner, a cord extending from the corner and having a remote loop portion spaced from the corner and having a base mounted in the corner for cooperating with the corner piece to hold the corner and the sheet anchored and to raise the corner for emptying material positioned in a pocket formed between the upper surface of the corner piece and the lower surface of the sheet, the pocket being positioned beneath a corner portion of a lower surface of the sheet, whereby the sheet may be anchored by positioning materials in the pocket and the pocket may be emptied by lifting the loop, which causes the materials to fall directly to the ground and away from the upper surface of the sheet.

2. The sheet of claim 1 wherein the sheet material is rectangular and wherein the edges define four corners and wherein each corner is provided with a corner piece positioned beneath a corner portion of a lower surface of a sheet.

3. The sheet of claim 1 wherein the edges of the sheet are re-entrantly bent downward and inward and are stitched to form a seam along each edge and wherein the first and second edges of the corner piece are folded inward within the seam along portions of the edges of the sheet which form the corner and wherein the base of the cord is anchored within inwardly folded portions of the first and second edges and within the downwardly and inwardly folded edges of the sheet, thereby securing the cord within folded portions of the corner piece and of the sheet for tightly anchoring the cord.

4. The sheet of claim 1 further comprising a drawstring pouch having closed edges and having one open edge which is closed by a drawstring, the pouch and the sheet and the corner pieces being made of identical material, whereby the pouch is used to receive valuables and to hide valuables within the space between the at least one corner piece and the lower surface of the sheet when the sheet is in use and wherein the pouch holds the folded sheet when the sheet is not in use.

5. The sheet of claim 1 wherein edges of the sheet define four corner portions and wherein each corner portion is provided with a corner piece positioned beneath a lower surface portion of the sheet and wherein the corner portions are filled with small materials for holding the sheet on a flat surface.

6. A multi-purpose sheet comprising a large, flat, rectangular body constructed of single-ply, soft material having upper and lower sides and having peripheral edges, the peripheral edges forming four corners, a triangular piece mounted in each corner, the triangular pieces having upper and lower surfaces and having first, second and third edges, the upper surface of each corner piece being juxtaposed to a corner portion of a lower surface of the multi-purpose sheet, the first and second edges of each corner piece being connected to portions of the edges of the sheet which form the corners, and the third edge of each corner piece being unattached to provide openings into four corner pockets formed by the connection of the corner pieces to the multi-purpose sheet, the pockets facing inwardly and receiving weighting materials to provide anchoring means, the anchoring means, when the sheet is positioned horizontally on the ground or beach, allowing wind to blow under causing the sheet to billow and flap, thereby creating a self-cleaning and drying action, and a cord extending from each corner and having a remote loop portion spaced from the corner and having a base mounted in the corner for cooperating with the corner piece to provide means for holding each corner by hand, auxiliary means for anchoring each corner, and means for raising each corner for emptying the weighting material from the pockets.

7. The sheet of claim 6 wherein, the pockets being emptied, the sheet is wrapped around a person and worn as an article of clothing.

8. The sheet of claim 7 wherein the sheet is displayed as an emergency signaling device.

9. The sheet of claim 6 wherein, two pockets being emptied, the straps corresponding to the emptied pockets are used as above-ground anchors to vertically incline the sheet to form a tent.

* * * * *